United States Patent [19]

Brotcke

[11] Patent Number: 4,918,763

[45] Date of Patent: Apr. 24, 1990

[54] WATER CLOSET WITH SUPPLEMENTED RIM WASH WATER FLOW

[75] Inventor: John J. Brotcke, Germantown, Wis.

[73] Assignee: Canaceramic Limited, Tortola, British Virgin Isls.

[21] Appl. No.: 300,047

[22] Filed: Jan. 23, 1989

[51] Int. Cl.[5] ..... E03D 1/24

[52] U.S. Cl. ..... 4/331; 4/366; 4/380

[58] Field of Search ..... 4/329–332, 4/345, 346, 386, 366, 374, 380

[56] References Cited

U.S. PATENT DOCUMENTS

| | | | |
|---|---|---|---|
| 1,670,324 | 5/1928 | Teahen et al. | 4/331 |
| 1,763,524 | 6/1930 | Joiner et al. | 4/331 |
| 2,073,835 | 3/1937 | Finley et al. | 4/374 |
| 2,412,691 | 12/1946 | Owens | 4/374 |
| 3,003,156 | 10/1961 | Alexander | 4/386 |
| 3,147,762 | 9/1964 | Ducey | 4/331 X |
| 3,172,128 | 3/1965 | Ducey | 4/366 X |
| 3,348,242 | 10/1967 | Wilhelm | 4/366 |
| 4,024,589 | 5/1977 | Klessig | 4/374 |
| 4,408,361 | 10/1983 | Pozek | 4/331 |

*Primary Examiner*—Henry J. Recla
*Assistant Examiner*—R. M. Fetsuga
*Attorney, Agent, or Firm*—James E. Nilles; Donald C. McGaughey

[57] ABSTRACT

A water closet is disclosed having a bowl with rim wash outlets and a tank connected thereto containing flushing water at a level where most of the water will not flow by gravity through the bowl rim outlets. A tank water withdrawing device is mounted in the tank and is automatically activated when flushing is initiated to withdraw water from the tank and direct it to the bowl rim outlet to supplement the volume of water flowing from a water supply inlet connected to the tank to conserve water usage and provide proper rim wash at low water supply pressure.

4 Claims, 3 Drawing Sheets

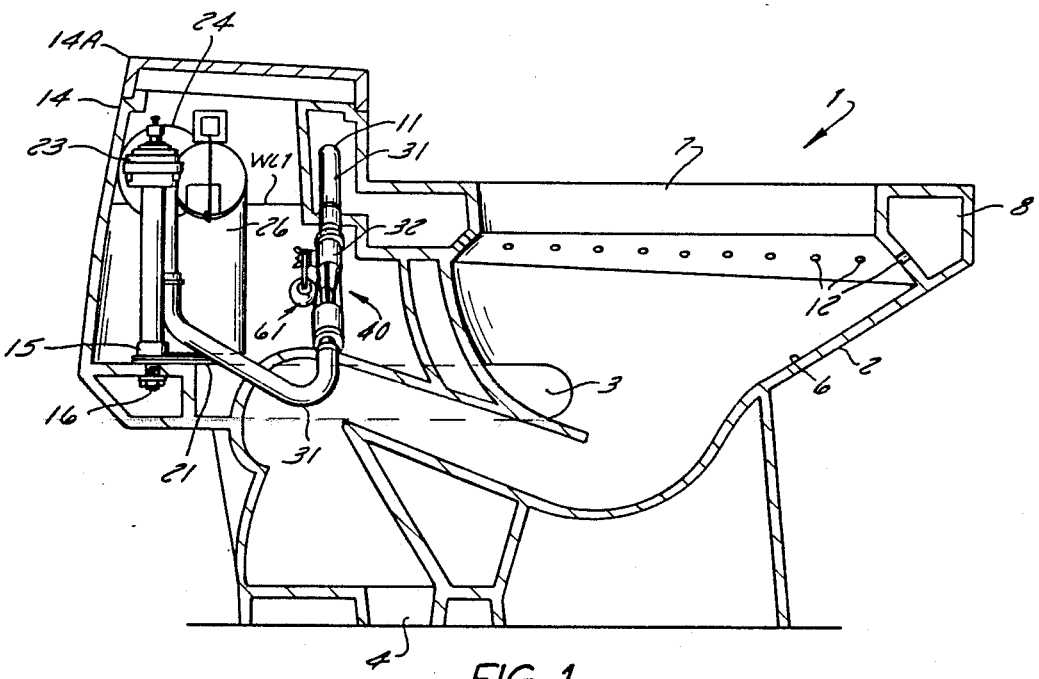
FIG. 1
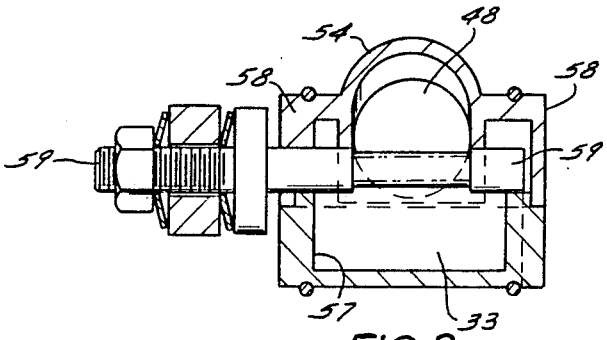
FIG. 3
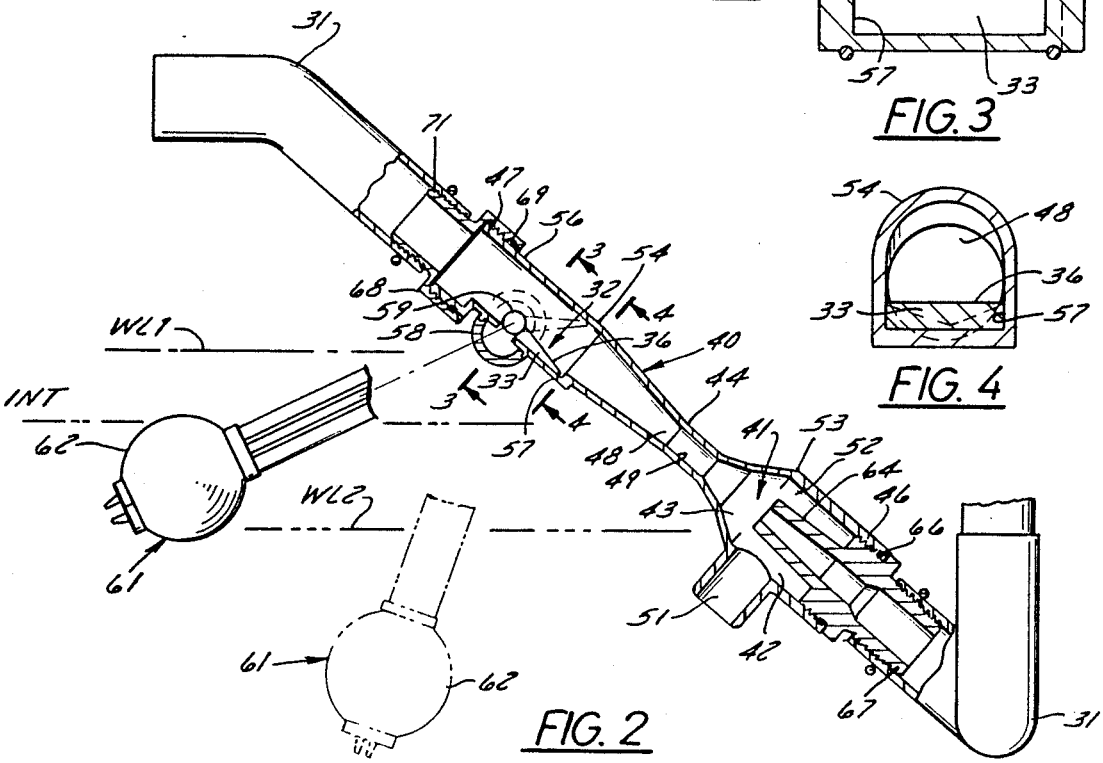
FIG. 2
FIG. 4

WATER CLOSET WITH SUPPLEMENTED RIM WASH WATER FLOW

BACKGROUND OF THE INVENTION

1. Field of the Invention

This invention relates generally to a water closet of the type having a tank for storing water at a level whereat a substantial volume of the water will not gravity flow into the bowl rim, and more particularly to an arrangement including a tank water withdrawing means for causing tank water to be utilized during flushing to supplement flow to the bowl rim from the main water supply.

2. Description of the Prior Art

The most common type of water closet in use comprises a bowl and a flush water tank mounted above the bowl. Upon flushing, all of the flush water in the tank will flow by gravity into the bowl. Usually the bowl and tank are in separate pieces and thus this type is frequently termed a two-piece water closet. The bowl has an upper rim containing a water passage having a plurality of holes or jets through which water can flow. During flushing, all or substantially all of the flush water from the tank enters the bowl through rim jets to wash the bowl sides and this action is generally termed "rim wash". Two of the primary functions that a modern water closet should provide is water conservation in order to reduce the volume of water usage and an efficient rim wash for sanitation purposes. In order for a water closet to be classified as "water-saving" under United States standards (ANSI A112.19.2M-1982) or "conservation-type" under Canadian standards (Can/-CSA-B45-Series-88) it is required that the water closet use no more than an average of 3.5 gallons (13.5 liters) per flushing cycle with a water supply pressure in the range of 20 to 80 psi. With regard to rim wash, the ANSI standards provide that "an artist's fine point, felt-tipped pen containing a dark-colored, water soluble ink" be used to "ink a line around the circumference of the flushing surface at a level 1 in. (25 mm) below the rim jets of the bowl." To meet the rim wash performance requirement, "the total length of ink line segments remaining on the flushing surface after each initial flush shall not exceed 2 in. (50 mm) and no individual segment shall be longer than ½ in. (13 mm) based on average of the three test runs."

Two-piece water closets can easily meet the above standards which define the volume of water that can be used by a water-saving closet and the amount of rim wash required to meet sanitary and water-saving requirements because the tank is above the bowl and all, or substantially all, of the flush water can be directed to enter the bowl through the rim jets.

While a two-piece water closet operates quite satisfactorily, it does have two shortcomings: first, the two-piece water closet has an unreasonably high noise level during flushing and, second, from an aesthetic standpoint the high tank does not permit the water closet to have a low, designer-type profile that is now popular. The desire to reduce flushing noise and provide a low profile resulted in the development of a second type of water closet with the tank at substantially the same level as the bowl, and thus while such a water closet has low noise when flushing and a low profile, there is little or no head of water available to flow under the force of gravity into the rim jets to provide the required rim wash. This second type is generally called a low profile, one-piece water closet as the tank and bowl are usually molded in one piece even though the tank could be a separate component. In the one-piece water closet, the flush water is also introduced via the rim and an opening in the bowl adjacent a bottom portion thereof, but as there is virtually no gravity flow of flush water into the bowl rim, the rim wash of the sides of the bowl tends to be inadequate especially when the water supply pressure is low.

The prior art solution to the problem of providing an adequate flow of water into the rim for rim wash in a one-piece water closet is to install a diverting arrangement to divert the pressurized water from the water supply inlet directly to the rim during the first part of the flush cycle to provide the rim wash. This direct supply of water is then turned off when the rim wash is complete. This is an acceptable arrangement when the flow through the water inlet is at a pressure and volume sufficient to provide the required rim wash as detailed above and the water closet does not have to be rated as "water-saving". U.S. Pat. No. 4,408,361, issued Oct. 11, 1983 to Roy J. Rozck, discloses a typical prior art diverting arrangement. It is desired to provide a proper rim wash even with water supplied at a pressure as low as 20 psi with total water consumption per flush cycle not exceeding 3.5 gallons in order to achieve a water-saving rating. In many areas, water closets cannot be legally installed if they do not have a water saving rating. While the present one-piece water closet diverter arrangements do provide a flow of water to the rim, the volume of such flow is either not sufficient to meet the above discussed plumbing standards for rim wash at the low end of the pressure range, i.e., 20–25 psi or if it is sufficient, then the total volume used per flush is too high to permit the one-piece closet to be classified as a water-saving or conservation type.

Therefore, a need exists for providing a water closet, of the type wherein all of the flush water in the tank is at a level where it will not flow by gravity into the rim, with an arrangement that will meet plumbing standards regarding both rim wash and water conservation at all times even when the water supply pressure is at the low end of the range.

SUMMARY OF THE INVENTION

In accord with the present invention, there is provided a water closet having a tank water withdrawing means that will cause a portion of the water, stored in the tank prior to flushing, to be withdrawn during flushing dispite the lack of gravity induced flow so that some of the stored water will supplement the volume of water flowing from the water supply inlet into the rim passage during flushing whereby the water closet will meet plumbing standards for rim wash and water conservation.

In accord with one aspect of the present invention, a water closet is provided which comprises a bowl that includes an opening for admitting flush water, a water and waste discharge and sides which terminate in an upper bowl rim having a water conveying passage therein. The passage has a rim water inlet and a rim water outlet or rim jets for discharging water to wash the sides of the bowl. The water closet also includes a tank means for storing flush water at a first level whereat a substantial volume of the stored water will not flow by gravity into the rim. The tank has a water inlet for connection to a supply of water under pressure and a flush water outlet that is connected to the bowl flush water admitting opening. A water inlet valve means is mounted in the tank in flow control relation to the water inlet and is movable between water inlet open and closed positions by first water level sensing means in response to water level in the tank. A flush valve means is also mounted in the tank and manually movable to an open position to permit discharge of water from the tank into the bowl and automatically movable by a flush valve closing means to a closed position as the water level in the tank drops to a predetermined lower level. A rim water supply conduit is connected in flow communication between the water inlet valve and the rim water inlet and a flow control valve is mounted in the conduit for movement beween conduit open and closed positions. The water closet further comprises a tank water withdrawing means that includes a high suction zone having an output in fluid communication with the rim inlet and an aperture means connecting the high suction zone in fluid communication with the tank. The withdrawing means is automatically operable when water is flowing through the rim passage during flushing to cause a portion of the water stored in the tank to be withdrawn therefrom for flow into the rim inlet during flushing so that stored tank water will supplement the volume of water flowing from the water inlet to the rim passage. A second water level sensing means is connected to the flow control valve to cause this valve to be in its open position when the tank water level is at said first level or falling to an intermediate level between the first and second levels to permit flow of water from the water inlet valve when it is open, through said conduit to the rim inlet and to its closed position when the tank water level drops below the intermediate level to the second low level or is rising from the second level to the first level to stop flow to the rim passage and thus cause water flowing from the water inlet to flow back through the aperture means to refill the tank.

Preferably, the tank water withdrawing means comprises a venturi which is mounted in the rim water supply conduit. The venturi includes an upstream end connected to receive water from the water inlet valve, a high suction zone having an aperture means therein connecting the high suction zone in flow communication with the tank and a downstream end connected to the rim inlet so that a flow of water from said water inlet through said venturi during flushing will cause a portion of water in said tank to be aspirated therefrom into said conduit for flow to said rim passage. The aperture means may comprise a single bidirectional flow aperture through which water flows in one direction from the tank into the conduit when the flow control valve is in its open position and in the other direction from the conduit back into the tank when the flow control valve is in its closed position.

In accordance with a further aspect of the invention, the flow control valve includes a valve element mounted in the conduit downstream of said high suction zone for pivotal movement between said conduit open and closed positions. The valve will be held in its closed position by the flow of water through the high pressure zone which creates a pressure in said venturi during operation which will exist until the first water level sensing means moves the water inlet valve to its closed position. Preferably the second water level sensing means will comprise a float element which is connected to pivot said valve element between its open and closed positions in response to the level of water in said tank.

The present invention also provides a venturi and flow control valve which comprises an axially extending housing that includes a bore extending axially therethrough having an interior surface defining a path of fluid flow from an upstream end of the housing to a downstream end thereof. The housing has a restricted portion and a first enlarged portion surrounding the restricted portion for creating a zone of high suction when fluid is passing through a bore. The venturi also includes an aperture through the housing in fluid communication with the high suction zone and a valve element which is pivotally mounted in the housing downstream from the high suction zone for movement between bore open and bore closed position. Preferably the housing has a valve receiving portion which includes a peripheral recessed area and wherein the valve element has upstream and downstream surfaces with the valve element mounted in the valve receiving portion for pivotal movement about a pivot axis that extends transversely to the axis of the housing to thereby place the valve element when in its open position in the recessed area so that the upstream surface thereof will form a smooth continuation of the interior surface of the venturi bore. Preferably the valve receiving portion comprises a second enlarged portion in the venturi housing that is spaced downstream from the first enlarged portion and has transversely spaced pivot bosses with said valve element having transversely spaced pivot shaft portions pivotally mounted in said bosses.

BRIEF DESCRIPTION OF THE DRAWINGS

In the drawings:

FIG. 1 is a side elevational view of a water closet, partly in section, incorporating the invention;

FIG. 2 is a side elevational view, partly in section, of a tank water withdrawing means in the water closet showing a valve element in two alternative positions of adjustment;

FIG. 3 is a sectional view taken along line 3—3 of FIG. 2;

FIG. 4 is a sectional view taken along line 4—4 of FIG. 2;

DESCRIPTION OF THE PREFERRED EMBODIMENT

Figure 5:
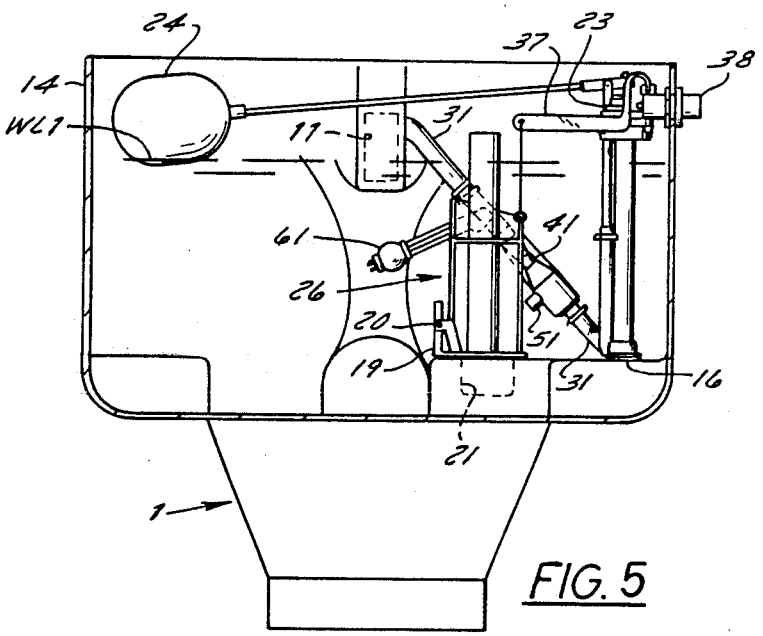
FIG. 5 is a rear elevational view of the water closet shown in FIG. 1, partly in section.
Figure 5A:
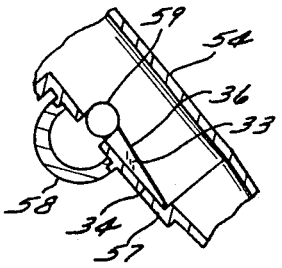
FIG. 5A is a detail view of the valve element in the water closet of FIG. 5 showing the flushing mechanism in one position.

Referring to FIG. 1, the water closet 1 comprises a bowl 2 which includes an opening 3 at a lower portion thereof for admitting flush water. The bowl 2 also includes a water and waste discharge opening 4 and sides 6 which terminate at their upper edge in a bowl rim 7 having a water conveying passage 8 therein. A rim water inlet 11 is provided into the water conveying passage 8. The water conveying passage 8 also has a rim water outlet means 12 in the form of a plurality of rim jet passages for discharging rim wash water during flushing.

The water closet additionally comprises a tank means 14 which may be formed integrally with the bowl 2. The tank means includes a watertight housing for storing flush water at a first full level WL1 whereat a substantial volume of the water stored in the tank will now flow by gravity into the rim passage. The tank includes a removable cover 14A, a water inlet valve means 15 adapted to be connected to a supply of water 16 under pressure and a flush water outlet 21 which is connected in fluid communication with the water closet bowl flush water admitting opening 3.

A water inlet valve means 23 is mounted in the tank in flow control relation to the water inlet 16. The water inlet valve means may comprise a ball cock assembly which is movable between a water inlet open position and a water inlet closed position by a first water level sensing means in the form of a float element 24.

Figure 6:
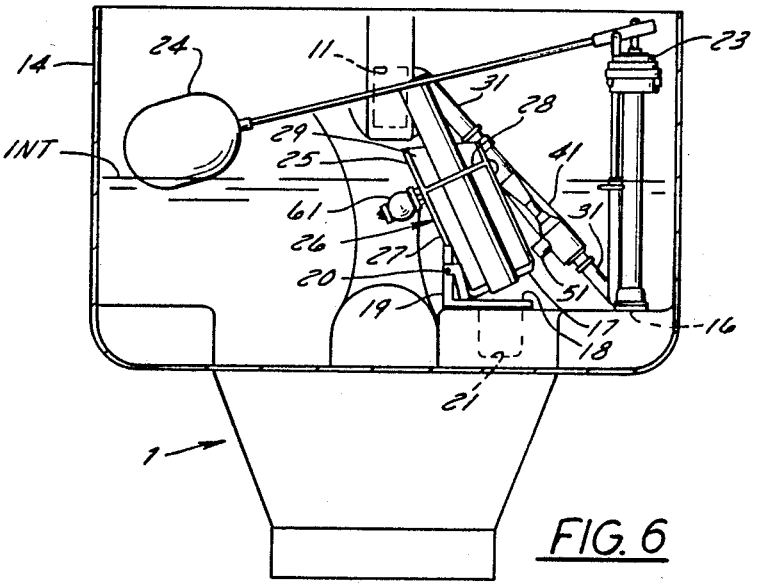
FIG. 6 is a rear elevational view of the water closet shown in FIG. 1, partly in section.
Figure 6A:
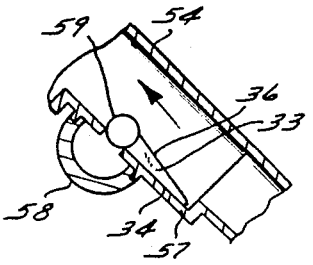
FIG. 6A is a detail view of the valve element in the water closet of FIG. 6 showing the flushing mechanism in a second position.
Figure 7:
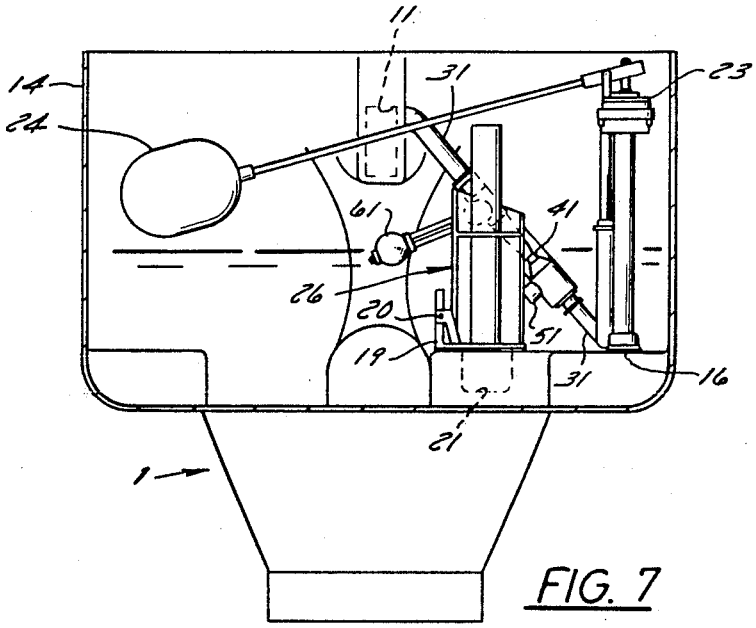
FIG. 7 is a rear elevational view of the water closet shown in FIG. 1, partly in section.
Figure 7A:
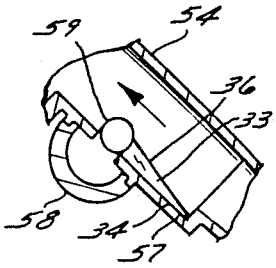
FIG. 7A is a detail view of the valve element in the water closet of FIG. 7 showing the flushing mechanism in a third position.

A flush valve means 26 in the form of a flapper valve is mounted in the tank and is manually movable by a flush lever actuating linkage 37 (FIG. 5) to an open position to permit discharge of water from the tank through the flush water outlet 21 and into the bowl 2. The flapper valve is automatically movable by a flush valve closing means to a closed position as the water level in the tank drops toward a low second level WL2, best shown in FIG. 8. With reference to FIG. 6, it will be noted that the flapper valve 26 comprises a cylindrical element 27 having a transverse web 28 defining a water reservoir 29 in an upper portion thereof. The reservoir 29 has a weep hole 25 therein. The reservoir 29 and weep hole 25 comprise the flush valve closing means and the function thereof will be described hereinafter. The lower end of the cylindrical element is provided with a first valve seat 17 which mates in sealing relation with a second valve seat 18 surrounding the flush water outlet 21. The flapper valve cylindrical element 27 is pivotally mounted on an upstanding bracket 19 adjacent the flush water outlet 21 for pivotal movement about a pivot axis 20 to an open position as shown in FIG. 6 and a closed position as shown in FIG. 5.

To initiate flushing, a manual actuating button 38 (FIG. 5) is pushed in to tilt the cylindrical element to the position shown in FIG. 6. The center of gravity of the water in the reservoir 29 is now to the left of the pivot axis 20. The weight of the water in the reservoir will tend to keep the flapper valve in the open position until the water in the tank reservoir falls below the weep hole 25. At this point, water starts to drain out through the weep hole 25 and when enough water drains from the reservoir 29, the center of gravity of the flapper valve shifts to the right of pivot axis 20. Shifting of the center of gravity to the right causes the flapper valve to close. The full sequence of the flushing operation will be more fully described hereinafter.

As best shown in FIGS. 1 and 2, a rim water supply conduit means 31 is mounted in the tank 14 and connected in flow communication between the water inlet valve 23 and the rim water inlet 11. The purpose of conduit 31 is to convey rim wash water to the rim during part of the flushing operation and to convey tank refilling water to the tank after the rim wash operation is complete as will be more fully described hereinafter. A flow control valve means in the form of a valve 32 is mounted in the conduit 31 and movable between conduit open and conduit closed positions.

A tank water withdrawing means 40 is mounted in the tank to withdraw water from the tank and supply it to the bowl rim 7 during the rim wash phase of the flushing cycle. In the embodiment shown, the tank water withdrawing means 40 comprises a venturi 41 mounted in the conduit 31, although other types of tank water withdrawing means could be used.

More specifically, the venturi 41 comprises an axially extending housing that includes a bore 48 extending axially therethrough. The bore 48 has an interior surface 49 that defines a path of fluid flow from one upstream end 46 of the housing to the other downstream end 47 of the housing. The upstream end 46 is connected to receive water from the water inlet valve 23 and the downstream end 47 is connected to the rim inlet passage 11. The housing also includes a restricted portion 52 and a first enlarged portion 53 surrounding the restricted portion that will create a high suction zone 42 when water flows therethrough. The high suction zone includes annular output 43 and an aperture means 51 in the form of a single bidirectional aperture extending through the venturi housing to place the high suction zone in fluid communication with the tank. The aperture means 51 connects the high suction zone 42 in flow communication with the tank so that flow of water from the water inlet valve 23 will flow through the venturi during one phase of the flushing operation to cause a portion of the water from the tank to be aspirated into the conduit 31 for flow into the rim passage, as will be more fully explained hereinafter. If desired, the aperture means 51 could comprise two apertures having valve means permitting fluid flow in opposite directions. The restricted portion 52 of the venturi is provided with a jet 64 which is threaded into the upstream end of the housing and sealed therein by an 0-ring 66. The projecting free end 67 of jet 64 is serrated and clamped in the rim water supply conduit 31.

The flow control valve means 32 is mounted in the conduit 31 downstream of the venturi 41 and includes a valve element 33. The flow control valve 32 can be an independent element in conduit 31, but preferably it is an integral part of a venturi and flow control valve unit as will now be described. The downstream end 47 of venturi housing 44 includes a valve receiving portion constituted by a second enlarged portion 54. The second enlarged portion 54 is provided with a peripheral recessed area 57. The valve receiving portion 54 of the venturi housing is also provided with transversely spaced pivot bosses 58. The valve element 33 is provided with projecting pivot shafts 59 which are pivotally mounted in the transversely spaced pivot bosses. The valve element 33 has an upstream surface 34 and a downstream surface 36. The peripheral recessed area 57 is configured and dimensioned to receive the valve element 33 therein so that the valve element when in its open position will be received in the recessed area with the downstream surface 36 forming a smooth continuation of the interior surface of the bore. A coupling member 68 is connected in sealed relation to the housing end 47 by an 0-ring 69. The coupling has a projecting free end 71 which is serrated and clamped in the rim water supply conduit 31.

The second water level sensing means 61 includes a float element 62 having an arm that is adjustably connected to one of the pivot shaft portions 59 by a nut. As the float 62 of the second water level sensing means rises and falls in response to the level of water in the tank, it will move the valve element 33 between conduit open and closed positions. In operation, as the water flows through the venturi bore 48, the pressure of the water on the downstream surface 36, when the valve element 33 is open, will tend to keep the valve element open despite reduced lifting force applied to float 62 caused by water level droppage in the tank, and conversely when the valve element 33 is in its closed position, pressure of the water in the venturi housing against the upstream surface 34 of the closed valve element will tend to keep the valve element in the closed position even though increased lift will be exerted against the float element as the water rises in the toilet tank as will be more fully explained hereinafter.

The venturi and flow control valve can be mounted anywhere in conduit 31 as long as the intake of the aperture means 51 is positioned so that it is below the lowest level that the water in the tank will assume during that phase of the flushing cycle which requires a flow of supplemental water from the tank into the rim wash passage inlet 11. Preferably the venturi and flow control valve is mounted in the tank with the aperture 51 closely adjacent the bottom of the tank so that it can most efficiently function as both an intake for withdrawing water from the tank during rim wash and an input for filling the tank with water when the float control valve is closed after the rim wash is complete.

OPERATION

The operation of the water closet will now be described with particular reference to FIGS. 5–8. FIG. 5 shows the preflushing condition of the water closet with the water therein at the full WL1 level. The water inlet valve 23 and the flapper valve 26 are closed and the flow control valve element 33 in conduit 31 is open.

Figure 8:
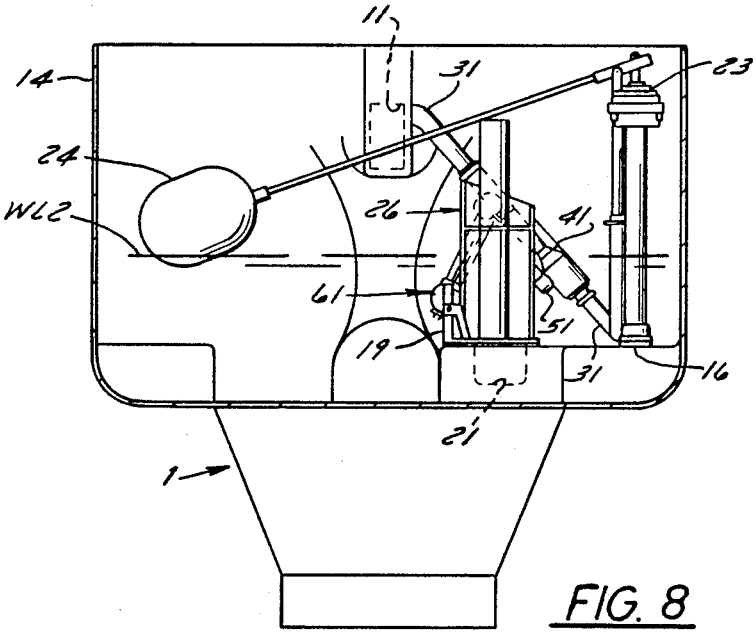
FIG. 8 is a rear elevational view of the water closet shown in FIG. 1, partly in section.
Figure 8A:
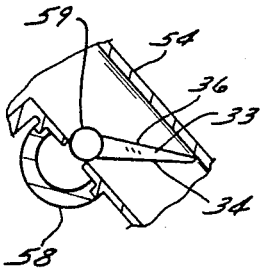
FIG. 8A is a detail view of the valve element in the water closet of FIG. 8 showing he flushing mechanism in a fourth position.

To initiate the flushing action, the flapper valve 26 is manually moved by a tank flushing button 38 to the position, shown in FIG. 6, thus opening the flush water outlet 21. When the flush water outlet opens, several functions take place simultaneously. Float 24 drops as the water level falls to an intermediate level INT, which comprises a constantly changing series of levels within a range, thus opening water inlet valve 23. Because the flow control valve element 33 is open, the water inlet flow will be directed through conduit 31 to initiate the supply of water to the rim wash passage 8. As water is now flowing through the tank water withdrawing venturi 41, high suction will occur in the high suction zone 42 causing water to be aspirated from the tank through aperture 51 into the stream of water flowing through conduit 31 so that the limited volume of water available from the water inlet will be supplemented to the degree necessary to provide a sufficient total volume of water flow necessary to provide a rim wash which will meet applicable plumbing standards even when the water inlet pressure is low. As the water level in the tank drops within the intermediate range, it will ultimately expose weep hole 25 in reservoir 29 as shown in FIG. 6 and water will discharge through the weep hole to empty the flapper valve reservoir 29 which results in the flapper valve returning to the closed position shown in FIG. 7. As the water in the tank is now in the intermediate level range below the full level, float 24 is in a lowered position, water inlet valve 23 remains open and water flowing through the venturi 41 will continue to withdraw water by aspirating it through the aperture 51. Thus the intermediate level INT of the water in the tank will continue to drop until the water is no longer high enough to provide any buoyancy to float 62. During this time, the pressure of the water flowing past the downstream face 36 of valve element 33 will provide force to assist in maintaining the valve in its fully open position. When float 62 is no longer buoyed upward by the water, its weight will overcome the force of water on the valve element 33 and float 62 will start to drop. When float 62 drops, the valve element 33 will elevate out of the recessed area and as soon as this happens, the stream of water flowing through the conduit 31 will impinge against the upstream side 34 of the valve element and immediately force the valve element 33 to pivot to the closed position, as shown in FIG. 8, stopping the flow of water to the rim. When the valve element 33 is moved to the closed position, the pressure of water in the conduit 31 on the upstream side 34 of the valve element 33 will continue to keep the valve element closed. At this stage of the flushing operation, the water inlet valve 23 remains open as the ball float 24 which controls it is in the lowered position due to the fact that the water level in the tank has been lowered to the low WL2 level. Because the water flowing through the water inlet valve cannot pass the now closed valve element 33, the water will exit aperture 51 and begin refilling the tank. At this phase, flow of water to the rim wash passage 8 has stopped and the tank is refilling. As the tank refills, the float 24 gradually rises to the point where it will close the water inlet valve 23. As the water rises it will buoy float 62 upward but the pressure of water on valve element 33 will overcome the opening movement exerted thereon by the flotation of valve element float 62 and the valve element will remain closed. When water inlet valve 23 finally closes, there no longer is water pressure in conduit 31 to force the valve element 33 to the closed position. Thus when the water inlet valve 23 closes, the buoyancy exerted by float 62 is now strong enough to move valve element 33 to its open position, thus returning the flushing mechanism to the status shown in FIG. 5 wherein it is ready for another flush cycle.

The preferred embodiment as above described utilizes a flow control valve and venturi arrangement to provide the required water tank withdrawing means for supplementing the flow of water to the rim for rim wash purposes. However, it is within the scope of the present invention to utilize other water tank withdrawing means such as a power driven pump means, not shown, in the tank in place of the venturi 41. If a pump means were used, the high suction zone of the pump would be connected in fluid communication with the water in the tank and the pump would have an output aperture connected to the rim wash inlet. A sensing means would be provided to automatically activate the pump in response to initiation of a flushing cycle to cause the flow of water into or through the rim passage 8 during the flushing operation so that tank water could be used to supplement the flow of water from the water supply inlet. If a pump means were used to provide the water tank withdrawing means, the venturi would be eliminated but the flow control valve 32 would operate in the manner as previously described.

The described embodiment provides a water closet of the type, wherein little or no water in the tank will flow by gravity to the rim, that will utilize water stored in the tank to supplement the flow of water to the rim during flushing to provide a rim wash which will meet rim wash standards while using a total volume of water per flush that is low enough to enable the water closet to be classified as water-saving. The embodiment disclosed is illustrative and other modifications will be apparent to those skilled in the art without departing from the scope of my invention.

What is claimed is:

1. A water closet (1) comprising:

a bowl (2) which includes an opening (3) for admitting flush water, a water and waste discharge (4), and sides (6) terminating in a bowl rim (7) having a water conveying passage (8) therein, a rim water inlet (11) into said passage and rim water outlet means (12) from said passage for washing said bowl sides;

a tank means (14) for storing flush water at a full first level (WL1) whereat a substantial volume of said water will not flow by gravity into said rim and having a water inlet (15) for connection to a supply of water (16) under pressure and a flush water outlet (21) connected to said bowl flush water admitting opening;

a water inlet valve means (23) mounted in flow control relation to said water inlet and movable between water inlet open and closed positions by a first water level sensing means (24) in response to the water level in said tank;

a flush valve means (26) mounted in said tank and manually movable to an open position to permit discharge of water from said tank into said bowl and automatically movably by a flush valve closing means to a closed position after said water level in said tank drops;

a rim water supply conduit means (31) including a longitudinal flow path, said conduit means connected in flow communication between said water inlet valve means and said rim water inlet;

a flow control valve means (32) having a valve element mounted in said conduit movable between conduit open and closed positions;

a tank water withdrawing means (40) including a high suction zone (42) below said rim inlet having an output (43) in fluid communication with said rim inlet and an aperture means (51) connecting said zone in fluid communication with said tank, said withdrawing means being automatically operative only when water is flowing through said rim passage during flushing to cause a portion of the water stored in said tank to be withdrawn for flow upward into said rim inlet during flushing so that stored tank water will supplement the volume of water flowing from said water inlet to said rim passage; and a second water level sensing means (61) including a float element having an adjustable connection to said valve element to move the latter between said conduit open and closed positions, said adjustable connection permitting the position of said float element to be regulated relative to the position of said valve element to cause said flow control valve means to be in said open position when said tank water level is at said first level and remains in said open position when said water level is falling to an intermediate level (INT) below said first level to permit water from said water inlet valve means, when open, to immediately flow through said conduit to said rim inlet; and to move to said closed position when said tank water level drops below said intermediate level to a second level and remains in said closed position when said water level is rising from said second level to said first level to enable flow to said rim passage to be stopped at any desired time after minimum rim wash requirements have been met to minimize the amount of water used for rim wash, and then cause water flowing from said water inlet to flow through said aperture means to refill said tank.

2. A water closet according to claim 1 wherein said flow control valve element (33) is mounted in said conduit for pivotal movement, about an axis that is laterally offset from said longitudinal flow path, between conduit open and closed positions; and wherein said valve when closed will be held in said closed position by the pressure created thereon by water flowing through said conduit and out said aperture means during operation, with said pressure continuing to exist until said first water level sensing means moves said water inlet valve to its closed position.

3. A water closet according to claim 2 wherein said conduit includes a valve receiving portion (56) having a peripheral recessed area (57) and said valve element has upstream and downstream surfaces (34, 36), said valve element being mounted in said valve receiving portion for pivotal movement about a pivot axis extending transversely to the axis of said conduit to position said valve element, when in an open position, in said recessed area so that said upstream surface thereof will form a smooth continuation of said interior surface (49) of said conduit.

4. A water closet according to claim 3 wherein:

said valve receiving portion comprises an enlarged portion having transversely spaced pivot bosses (58) on each side of said conduit;

said valve element (33) has transversely spaced pivot shaft portion pivotally mounted in said pivot bosses; and said second water level sensing means (61) is connected to at least one of said pivot shaft portions.

* * * * *